United States Patent [19]

Godyak

[11] Patent Number: 4,962,334

[45] Date of Patent: Oct. 9, 1990

[54] GLOW DISCHARGE LAMP HAVING WIRE ANODE

[75] Inventor: Valery Godyak, Andover, Mass.

[73] Assignee: GTE Products Corporation, Danvers, Mass.

[21] Appl. No.: 329,135

[22] Filed: Mar. 27, 1989

[51] Int. Cl.[5] ..... H01J 61/64; H01J 17/10

[52] U.S. Cl. ..... 313/619; 313/605; 313/632

[58] Field of Search ..... 313/619, 605, 606, 631, 313/632

[56] References Cited

U.S. PATENT DOCUMENTS

| | | | |
|---|---|---|---|
| 1,706,135 | 3/1929 | Baker | 313/632 X |
| 1,987,338 | 1/1935 | Heintz | 313/605 X |
| 2,403,184 | 7/1946 | Lemmers | 313/631 X |
| 2,945,977 | 7/1960 | Schönherr | 313/631 X |

*Primary Examiner*—Sandra L. O'Shea
*Attorney, Agent, or Firm*—Carlo S. Bessone

[57] ABSTRACT

A negative glow discharge lamp including a wire anode and a cathode disposed within a phosphor-coated envelope. The thickness radius of the wire used for the anode is less than the electron mean free path in the discharge. In a preferred embodiment, the wire anode is in the form of a cylindrical cage coaxially surrounding the cathode and includes a pair of wire rings spaced apart and interconnected by a plurality of transversing wire segments. The diameter of each of the wire rings and the length of each of the wire segments are greater than the electron mean free path in the discharge. The wire anode does not attain a positive anode voltage drop (PAVD) during lamp operation. As a result, the efficiency of the glow discharge lamp is improved.

11 Claims, 1 Drawing Sheet

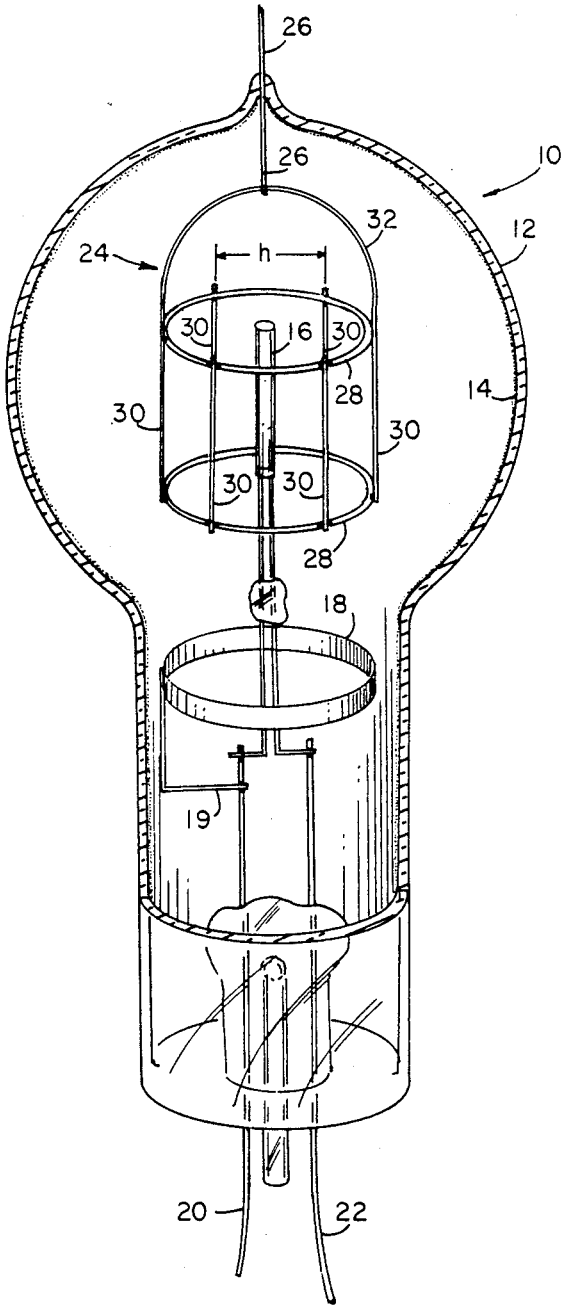
26
26
10
32
12
24
h
30
16
30
28
14
30
30
30
30
28
18
19
20
22

GLOW DISCHARGE LAMP HAVING WIRE ANODE

CROSS-REFERENCE TO A RELATED APPLICATION

This application discloses, but does not claim, inventions which are claimed in U.S. Ser. No. 07/328,994 filed concurrently herewith and assigned to the Assignee of this application.

FIELD OF THE INVENTION

This invention relates in general to electric discharge lamps and pertains, more particularly, to a negative glow discharge lamp having a wire anode.

BACKGROUND OF THE INVENTION

A negative glow lamp typically is comprised of a light-transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. The phosphor coating on the inner surface of the lamp envelope is caused to fluoresce and re-emit a substantial portion of the ultraviolet radiation as visible light. The spectral characteristics of the visible light is determined by the composition of the fluorescent powders used for the phosphor coating.

Examples of typical glow discharge lamps are found in U.S. Pat. No. 2,341,990 to Inman et al and U.S. Pat. No. 2,403,184 to Lemmers.

It is important that the anode electrode of the glow discharge lamp have a large enough surface to prevent a positive anode voltage drop (PAVD). At the same time, the anode has to be small enough to be transparent for ultraviolet and visible radiation. Both of these considerably affect the lamp efficiency. The PAVD appears around the anode when electron diffusion to the anode can not compensate the electron sink to the anode which corresponds to the discharge current. The development of a PAVD in discharges operating in a dc regime leads to useless anode heating and consequently to unnecessary electric power losses.

In a typical negative glow discharge lamp operating in a dc regime, the anode is in the form of a rectangular plate which is positioned normal to the cathode direction. The rectangularly-shaped anode plate is 2.0 centimeters by centimeter and is placed 1.0–2.0 centimeters from the cathode. This configuration results in only one side of the anode plate facing the cathode. As a result, the opposite side of the anode plate seldom takes part in electron collection because of the screening effect. Plasma density on this opposite side is much smaller than that on the side facing the cathode. Accordingly, the anode has the collection surface close to the screening light surface. Moreover, plasma density around this anode should be considerably depleted which results in a positive anode voltage drop.

SUMMARY OF THE INVENTION

It is, therefore, an object of the present invention to obviate the disadvantages of the prior art.

It is still another object of the invention to provide an improved negative glow discharge lamp having increased lamp efficiency.

It is a further object of the invention to provide a negative glow discharge lamp having an anode which achieves zero (or slightly negative) anode voltage drop at a smaller anode surface so as to provide minimum plasma and light shading effects.

To accomplish the foregoing and other objects, features and advantages of the invention there is provided a negative glow discharge lamp that is comprised of a light-transmitting envelope containing a gas fill material. A phosphor coating is disposed on the inner surface of the envelope. A cathode is located within the envelope for emitting electrons. An anode of wire is also located within the envelope. The wire of the anode has a thickness radius less than the electron mean free path in the discharge. The wire anode does not attain a positive anode voltage drop (PAVD) during operation of the lamp. Lead-in wires are coupled to the cathode and anode and extend through and are hermetically sealed in the envelope.

In accordance with further teachings of the present invention, the wire anode is in the form of a cylindrical cage coaxially surrounding the cathode and includes a pair of wire rings spaced apart and interconnected by a plurality of transversing wire segments. The diameter of each of the wire rings and the length of each of the wire segments are greater than the electron free path in the discharge. Preferably, the wire rings lie in parallel planes perpendicular to the axis of the cathode.

In accordance with further aspects of the present invention, the fill material includes neon at a pressure of 2 torr and the thickness radius of the wire used for the anode is 0.25 millimeter.

BRIEF DESCRIPTION OF THE DRAWING

The invention will become more readily apparent from the following exemplary description in connection with the drawing, wherein:

The sole FIGURE represents a front elevational view, partially broken away, of a negative glow discharge lamp according to the present invention.

BEST MODE FOR CARRYING OUT THE INVENTION

For a better understanding of the present invention, together with other and further objects, advantages and capabilities thereof, reference is made to the following disclosure and appended claims in connection with the above-described drawing.

Referring now to the drawing with greater particularity, there is shown in the sole FIGURE a negative glow discharge lamp 10 having an envelope 12 containing an ionizable medium. The envelope may contain a noble gas or mixtures thereof at a low pressure, such as, 1–5 torr. The inner surface of the envelope is coated with phosphor coating 14. As stated, the spectral characteristics of the visible light is determined by the composition of the fluorescent powders used for the phosphor coating.

The envelope further contains a cathode 16 which in the sole FIGURE may be in the form of an indirectly-heated cathode 16. Indirectly-heated cathode 16 includes a metallic cylinder coated with an emissive material. The cylinder surrounds a heater coil which is coated with alumina. As illustrated in the sole FIGURE, lead-in wires 20, 22 support the cathode 16 and provide current to the heater coil. The lead-in wires may be rod-like of say 20–30 mil diameter. Both of the lead-in wires 20, 22 are hermetically sealed at one end of lamp 10. Alternatively, cathode 16 may be in the form of a tungsten filament coated with an emissive material.

Glow lamp 10 may include a getter/mercury dispensing strip 18 which surrounds lead-in wires 20, 22 and is attached to lead-in wire 20 by means of conductor 19. One suitable material for strip 18 is ST101/505 manufactured by SAES Getters S.p.A, Milan, Italy.

Further included within envelope 12 is a wire anode 24 which during lamp operation does not attain a positive anode voltage drop (PAVD). In accordance with the teachings of the instant invention, the anode is constructed of a conductive material, such as wire, so that the anode will instead exhibit a zero or slightly negative voltage drop.

With particular attention to the embodiment illustrated in the sole FIGURE, the anode 24 is in the form of a cylindrical wire cage coaxially surrounding cathode 16. Anode 24 includes a pair of circular wire rings 28 spaced apart and interconnected around the periphery of the ring 28 by six equally spaced transversing wire segments 30. Wire rings 28 lie in parallel planes perpendicular to the longitudinal axis of lamp 10 and the axis of the cathode. Alternatively, the wire anode 24 may be oriented so that the wire rings lie in planes parallel to the axis of the lamp.

Although cathode 16 is illustrated as an indirectly-heated type, the cathode can be a filamentary exciter coil coated with an emissive material. The cathode 16 may, if desired, be mounted perpendicular to the lamp axis.

The diameter of each of the circular wire rings 28 is greater than the electron free path $\lambda_e$ in the discharge. The electron mean free path in a discharge device is a common expression familiar to those skilled in the art. For example, at fill pressures of 1 and 2 torr neon, the electron mean free path $\lambda_e$ is approximately 2 millimeters and 1 millimeter, respectively. Similarly, for fill pressures of 1 and 2 torr argon, the electron mean free path $\lambda_e$ is approximately 1.3 millimeters and 0.65 millimeter, respectively.

In order to prevent plasma density depletion from occurring between wires, the distance h measured between adjacent pairs of wire segments 30 as well as the length of each of the wire segments is greater than the electron free path in the discharge. In this regard, a mesh type anode with a cell distance $h \leqq \lambda_e$ produces an undesirable PAVD effect. The cell distance is defined as the minimum distance between pairs of parallel wires forming the mesh. Thus, to take advantage of using the wire type anode of the present invention, the following relationship should be satisfied $r < \lambda_e < h$; where r = the radius thickness of the wire used for the rings and segments, $\lambda_e$ = electron mean free path and h = the distance between adjoining parallelly disposed wire segments.

Anode 24 is electrically connected to lead-in wire 26 by means of a U-shaped support rod 32. Support rod 32 can be constructed from the same wire as ring 28 and segments 30. Lead-in wire 26 is hermetically sealed in envelope 12 at an end opposite lead-in wires 20, 22.

In a typical but non-limitative example of a negative glow discharge lamp in accordance with the teachings of the present invention, the wire anode is in the form of a cylindrical cage coaxially surrounding the cathode and includes two spaced apart wire rings each having a diameter of 1.0 inch (2.54 centimeter). The wire rings are interconnected by six transversing wire segments each having a length of 1.0 inch. The distance h between adjoining pairs of wire segments (and also the average cell distance) is about 0.5 inch (1.2 centimeters). The orientation of the cathode and wire cage anode is as illustrated in the sole FIGURE. The radius thickness of the wire used for the wire rings and segments is 0.25 millimeter.

There has thus been shown and described a negative glow discharge lamp. The invention provides a negative glow discharge lamp having an anode which achieves zero (or slightly negative) anode voltage drop at a smaller anode surface so as to provide minimum plasma and light shading effects. As a result, the efficiency of the negative glow discharge lamp is increased.

While there have been shown and described what are at present considered to be the preferred embodiments of the invention, it will be apparent to those skilled in the art that various changes and modifications can be made herein without departing from the scope of the invention. For example, the wire anode may be in the form of a single wire ring, several wire rings or a spiral of wire. The embodiment shown in the drawing and described in the specification is intended to best explain the principles of the invention and its practical application to hereby enable others in the art to best utilize the invention in various embodiments and with various modifications as are suited to the particular use contemplated.

What is claimed is:

1. A negative glow discharge lamp comprising:

a light-transmitting envelope containing a gas fill material;

a phosphor coating disposed on the inner surface of said envelope;

a cathode located within said envelope for emitting electrons;

an anode of wire located within said envelope, said wire of said anode having a thickness radius less than the electron mean free path in the discharge, said wire anode being effective in not attaining a positive anode voltage drop during operation of said lamp; and lead-in wires coupled to said cathode and anode extending through and hermetically sealed in said envelope.

2. The negative glow discharge lamp as set forth in claim 1 wherein said wire anode includes a wire ring having a predetermined diameter, said diameter being greater than the electron mean free path in the discharge.

3. The negative glow discharge lamp as set forth in claim 1 wherein said wire anode is in the form of a cylindrical cage surrounding said cathode.

4. The negative glow discharge lamp as set forth in claim 3 wherein said wire anode comprises a pair of wire rings spaced apart and interconnected by a plurality of transversing wire segments.

5. The negative glow discharge lamp as set forth in claim 4 wherein said wire rings lie in parallel planes perpendicular to the axis of said cathode.

6. The negative glow discharge lamp as set forth in claim 5 wherein the diameter of each of said rings and the length of each of said wire segments is greater than the electron mean free path of the discharge.

7. The negative glow discharge lamp as set forth in claim 6 wherein said wire anode coaxially surrounds said cathode.

8. The negative glow discharge lamp as set forth in claim 3 further including support means electrically connecting said cylindrical cage to said lead-in wire coupling said anode.

9. The negative glow discharge lamp as set forth in claim 1 wherein said fill material includes neon at a pressure of 2 torr.

10. The negative glow discharge lamp as set forth in claim 9 wherein said radius of said wire is 0.25 millimeter.

11. A negative glow discharge lamp comprising:

a light-transmitting envelope containing a gas fill material;

a phosphor coating disposed on the inner surface of said envelope;

a cathode located within said envelope and longitudinally disposed with respect to said lamp;

an anode of wire located within said envelope, said anode being in the form of a cylindrical cage coaxially surrounding said cathode, said wire anode including a pair of spaced apart wire rings lying in parallel planes perpendicular to the axis of said cathode, said wire rings being interconnected by a plurality of transversing wire segments, the diameter of each of said wire rings and the length of each of said wire segments being greater than the electron mean free path of the discharge, the thickness radius of said wire being less than said electron mean free path; and lead-in wires coupled to said cathode and anode extending through and hermetically sealed in said envelope.

* * * * *